US009819089B2

(12) United States Patent
Lee et al.

(10) Patent No.: US 9,819,089 B2
(45) Date of Patent: Nov. 14, 2017

(54) CIRCULARLY POLARIZED GLOBAL POSITIONING SYSTEM ANTENNA USING PARASITIC LINES

(71) Applicant: ELECTRONICS AND TELECOMMUNICATIONS RESEARCH INSTITUTE, Daejeon (KR)

(72) Inventors: Dae Heon Lee, Daejeon (KR); Woong Hee Kim, Changwon-si (KR); Dong Hoon Shin, Daejeon (KR); Jinchun Wang, Daejeon (KR); Inho Hwang, Daejeon (KR); Sangwoo Park, Daejeon (KR); Gangil Byun, Gwangmyeong-si (KR); Hosung Choo, Seoul (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 142 days.

(21) Appl. No.: 14/936,843

(22) Filed: Nov. 10, 2015

(65) Prior Publication Data

US 2017/0047657 A1 Feb. 16, 2017

(30) Foreign Application Priority Data

Aug. 11, 2015 (KR) ..... 10-2015-0113027

(51) Int. Cl.
*H01Q 9/04* (2006.01)
*H01Q 21/22* (2006.01)

(52) U.S. Cl.
CPC ..... *H01Q 9/0428* (2013.01); *H01Q 21/22* (2013.01)

(58) Field of Classification Search
CPC .. H01Q 9/0428; H01Q 9/0492; H01Q 9/0442; H01Q 9/045; H01Q 21/24
(Continued)

(56) References Cited

U.S. PATENT DOCUMENTS 7,038,631 B2 * 5/2006 Jecko ..... H01Q 9/0421 343/702
7,164,385 B2 * 1/2007 Duzdar ..... H01Q 9/0428 343/700 MS
(Continued)

FOREIGN PATENT DOCUMENTS

KR 10-2001-0068154 A 7/2001
KR 10-2010-0045200 A 5/2010
(Continued)

OTHER PUBLICATIONS

Gangil Byun et al., "Antenna polarisation adjustment for microstrip patch antennas using parasitic elements," Electronics Letters, vol. 51, No. 14, Jul. 9, 2015, pp. 1046-1048.
(Continued)

*Primary Examiner* — Dameon E Levi
*Assistant Examiner* — Jennifer F Hu
(74) *Attorney, Agent, or Firm* — LRK Patent Law Firm

(57) ABSTRACT

A circularly polarized Global Positioning System (GPS) antenna using parasitic lines, in which circular polarization is implemented to improve the efficiency of the reception of satellite signals by an antenna. For this, a circularly polarized GPS antenna using parasitic lines according to an embodiment includes a substrate, a radiating patch formed on a top of the substrate, a parasitic line part formed on the top of the substrate and disposed to be spaced apart from the radiating patch, thus implementing circular polarization characteristics by inducing reverse current, a ground plate formed on a bottom of the substrate, and a feeding via
(Continued)

formed through the substrate and configured to electrically connect the ground plate to the radiating patch.

12 Claims, 11 Drawing Sheets

(58) Field of Classification Search
USPC ..... 343/756
See application file for complete search history.

(56) References Cited

U.S. PATENT DOCUMENTS

2006/0097924 A1* 5/2006 Yegin ..... H01Q 9/0407 343/700 MS
2008/0204326 A1* 8/2008 Zeinolabedin Rafi ..... H01Q 9/0414 343/700 MS
2012/0319922 A1* 12/2012 Fuchs ..... H01Q 1/38 343/872
2014/0247194 A1* 9/2014 Durnan ..... H01Q 7/00 343/867
2014/0361952 A1* 12/2014 Dobric ..... H01Q 9/0428 343/893

FOREIGN PATENT DOCUMENTS

KR 10-2013-0041532 A 4/2013
KR 10-1489577 B1 2/2015

OTHER PUBLICATIONS

Shiqiang Fu et al., "Broadband Circularly Polarized Microstrip Antenna with Coplanar Parasitic Ring Slot Patch for L-Band Satellite System Application," IEEE Antennas and Wireless Propagation Letters, vol. 13, 2014.

* cited by examiner

100

CIRCULARLY POLARIZED GLOBAL POSITIONING SYSTEM ANTENNA USING PARASITIC LINES

CROSS REFERENCE TO RELATED APPLICATION

This application claims the benefit of Korean Patent Application No. 10-2015-0113027, filed Aug. 11, 2015, which is hereby incorporated by reference in its entirety into this application.

BACKGROUND OF THE INVENTION

1. Technical Field

The present invention generally relates to a circularly polarized Global Positioning System (GPS) antenna using parasitic lines and, more particularly, to a circularly polarized GPS antenna using parasitic lines, in which circular polarization is implemented to improve the efficiency of the reception of satellite signals by an antenna.

2. Description of the Related Art

Microstrip patch antennas, which are chiefly used as antennas for satellite communication, are implemented as planar antennas. Such a microstrip patch antenna is one of the most widely used kinds of antenna in Radio Frequency (RF) fields because the lightweight structure, integration, and arrangement of antennas are easily implemented, and the manufacturing process thereof is simplified to improve economic efficiency. In particular, in various applications for providing information about the time and location of moving objects, such as mobile devices, vehicles, vessels, and airplanes, a GPS antenna plays an important role.

However, such a GPS receives satellite signals transmitted from a location at an altitude of 20,000 km from the earth, and power is transferred while passing through the ionosphere. Accordingly, in order to minimize power loss in the ionosphere, an antenna having circular polarization characteristics is required.

In this way, in order to derive circular polarization characteristics, an antenna is generally designed such that the corners of a microstrip patch antenna are rasped off or slots are formed, thus enabling the direction of current induced in a radiating patch to be rotated depending on the phase. However, conventional technologies exhibit narrowband circular polarization characteristics, and the performance of such antennas is sensitive to the sizes of rasped-off corners and slots, thus requiring additional performance tuning.

In relation to this technology, Korean Patent Application Publication No. 10-2010-0045200 discloses a GPS ceramic patch antenna. Korean Patent Application Publication No. 10-2010-0045200 also discloses technology in which the corners of a radiating patch are rasped off so as to implement circular polarization, and slots having various shapes are additionally provided, but a problem arises in that the complexity of the design is increased due to a slot addition structure and the like.

SUMMARY OF THE INVENTION

Accordingly, the present invention has been made keeping in mind the above problems occurring in the prior art, and an object of the present invention is to improve the efficiency of the reception of satellite signals by a GPS antenna by implementing circular polarization.

Another object of the present invention is to implement circular polarization while maintaining the impedance matching characteristics and gain characteristics of an antenna.

A further object of the present invention is to implement an antenna that facilitates mass production and cost reduction while minimizing design complexity.

Yet another object of the present invention is to implement an antenna that can be applied in the form of an individual element of a small-sized array antenna by maximizing the efficiency of space utilization.

In accordance with an aspect of the present invention to accomplish the above objects, there is provided a circularly polarized Global Positioning System (GPS) antenna using parasitic lines, including a substrate; a radiating patch formed on a top of the substrate; and a parasitic line part formed on the top of the substrate and disposed to be spaced apart from the radiating patch, thus implementing circular polarization characteristics by inducing reverse current.

The parasitic line part may include a first parasitic line formed on the top of the substrate and disposed on one side of the radiating patch while being spaced apart from the radiating patch; and a second parasitic line formed on the top of the substrate and disposed on a remaining side of the radiating patch while being spaced apart from the radiating patch.

The first parasitic line and the second parasitic line may be formed symmetrically around the radiating patch.

The radiating patch may be formed in a shape of a rectangle including first and second sides that are opposite each other, a third side configured to connect a first end of the first side to a first end of the second side, and a fourth side configured to connect a second end of the first side to a second end of the second side.

The first, second, third and fourth sides may have an identical length to enable the radiating patch to be formed in a shape of a square.

The first parasitic line may include a first main parasitic line formed parallel to the first side while being spaced apart from the first side; and first and second sub-parasitic lines formed to be extended and bent from the first main parasitic line and formed parallel to the third and fourth sides, respectively, while being spaced apart from the third and fourth sides, respectively.

The second parasitic line may include a second main parasitic line formed parallel to the second side while being spaced apart from the second side; and third and fourth sub-parasitic lines formed to be extended and bent from the second main parasitic line and formed parallel to the third and fourth sides, respectively, while being spaced apart from the third and fourth sides, respectively.

An end of the first sub-parasitic line and an end of the third sub-parasitic line may be spaced apart from each other.

An end of the second sub-parasitic line and an end of the fourth sub-parasitic line may be spaced apart from each other.

Lengths of the first sub-parasitic line, the second sub-parasitic line, the third sub-parasitic line, and the fourth sub-parasitic line may be symmetrically adjusted, thus enabling circular polarization and a boresight gain to be controlled.

The circularly polarized GPS antenna may further include a ground plate formed on a bottom of the substrate; and a feeding via formed through the substrate and configured to electrically connect the ground plate to the radiating patch.

In accordance with another aspect of the present invention to accomplish the above objects, there is provided a circularly polarized Global Positioning System (GPS) antenna using parasitic lines, including a plurality of radiating parts, each including a substrate; a radiating patch formed on a top of the substrate; and a parasitic line part formed on the top of the substrate and disposed to be spaced apart from the radiating patch, thus implementing circular polarization characteristics by inducing reverse current.

The parasitic line part may include a first parasitic line formed on the top of the substrate and disposed on one side of the radiating patch while being spaced apart from the radiating patch; and a second parasitic line formed on the top of the substrate and disposed on a remaining side of the radiating patch while being spaced apart from the radiating patch.

Each of the plurality of radiating parts may be formed in a radial fan shape.

The radiating patch may be formed in a truncated fan shape to correspond to the shape of the corresponding radiating part.

The plurality of radiating parts may constitute a Controlled Reception Pattern Antenna (CRPA).

The circularly polarized GPS antenna may further include a ground plate formed on a bottom of the substrate; and a feeding via formed through the substrate and configured to electrically connect the ground plate to the radiating patch.

The ground plate may be configured such that slots are formed in portions of the ground plate, corresponding to connecting portions between the radiating parts.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
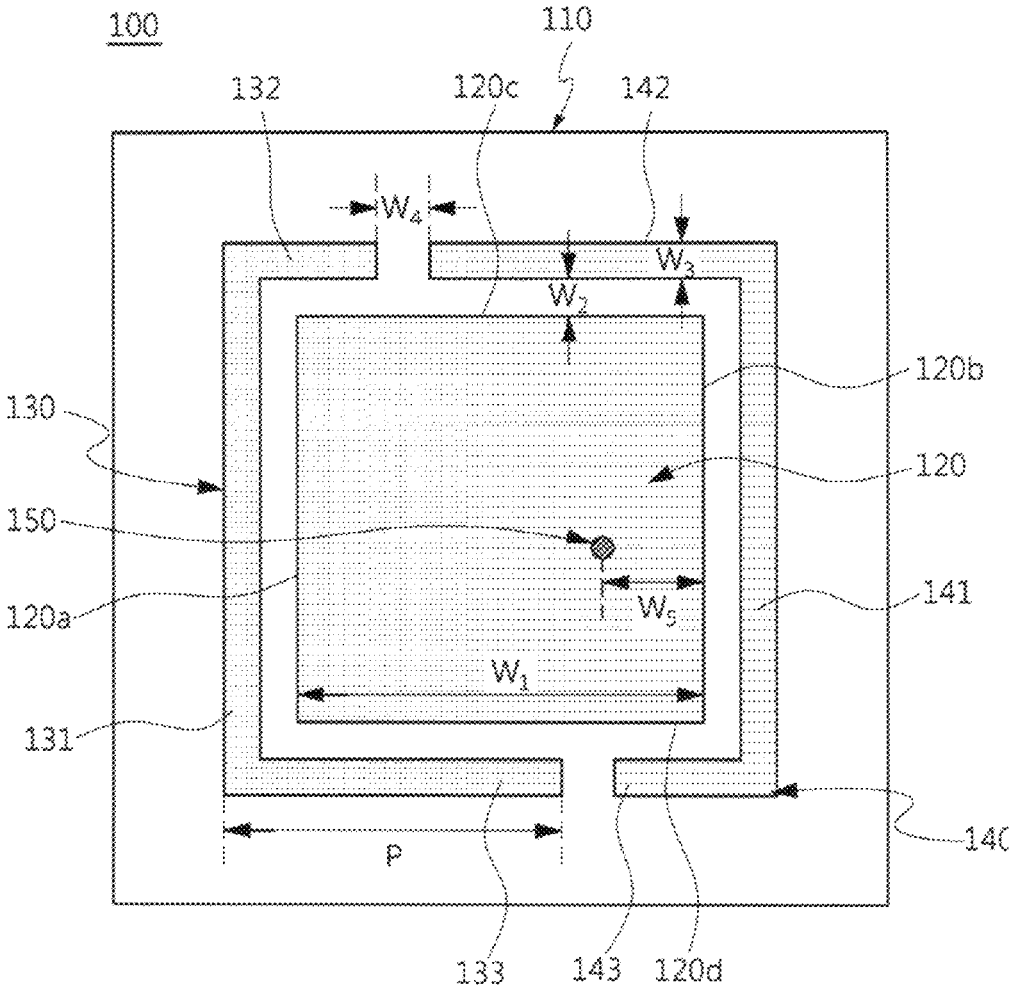
FIG. 1 is a diagram showing the structure of a circularly polarized GPS antenna using parasitic lines according to an embodiment of the present invention.

The present invention will be described in detail below with reference to the accompanying drawings. Repeated descriptions and descriptions of known functions and configurations which have been deemed to make the gist of the present invention unnecessarily obscure will be omitted below. The embodiments of the present invention are intended to fully describe the present invention to a person having ordinary knowledge in the art to which the present invention pertains. Accordingly, the shapes, sizes, etc of components in the drawings may be exaggerated to make the description clearer.

Hereinafter, the structure and operation of a circularly polarized GPS antenna using parasitic lines according to an embodiment of the present invention will be described in detail with reference to the attached drawings.

FIG. 1 is a diagram showing the structure of a circularly polarized GPS antenna using parasitic lines according to an embodiment of the present invention.

Referring to FIG. 1, a circularly polarized GPS antenna 100 using parasitic lines according to the embodiment of the present invention may be formed to include a substrate 110, a radiating patch 120, a first parasitic line 130, a second parasitic line 140, a feeding via 150, and a ground plate (not shown).

The substrate 110 is made of a dielectric material and may be formed in the shape of a plate.

The radiating patch 120 is formed in a predetermined region on the top of the substrate 110. The radiating patch 120 may have the shape of a rectangle composed of a first side 120*a* and a second side 120*b* that are opposite each other, a third side 120*c* configured to connect one end of the first side 120*a* to one end of the second side 120*b*, and a fourth side 120*d* configured to connect the other end of the first side 120*a* to the other end of the second side 120*b*. Further, the radiating patch 120 may be formed in the shape of a square, the first side 120*a*, the second side 120*b*, the third side 120*c*, and the fourth side 120*d* of which have the same length. Alternatively, the specifications of the radiating patch 120 may determine a resonant frequency.

A parasitic line part including the first parasitic line 130 and the second parasitic line 140 is formed on the top of the substrate 110. The parasitic line part is disposed to be spaced apart from the radiating patch 120 and is configured to induce reverse current, thus implementing circular polarization characteristics.

More specifically, the first parasitic line 130 may be formed on the top of the substrate 110, and may be disposed on one side of the radiating patch 120 while being spaced apart from the radiating patch 120. This first parasitic line 130 may be formed to include a first main parasitic line 131 that is formed parallel to the first side 120*a* of the radiating patch 120 while being spaced apart from the first side 120*a*, and a first sub-parasitic line 132 and a second sub-parasitic line 133 that are extended and bent from the first main parasitic line 131 and are formed parallel to the third side 120*c* and the fourth side 120*d*, respectively, while being spaced apart from the third side 120*c* and the fourth side 120*d*, respectively.

The second parasitic line 140 may be formed on the top of the substrate 110, and may be disposed on the other side of the radiating patch 120 while being spaced apart from the radiating patch 120. The first parasitic line 130 and the second parasitic line 140 may be formed symmetrically around the radiating patch 120. Further, the second parasitic line 140 may be formed to include a second main parasitic line 141 that is formed parallel to the second side 120*b* of the radiating patch 120 while being spaced apart from the second side 120*b*, and a third sub-parasitic line 142 and a fourth sub-parasitic line 143 that are extended and bent from the second main parasitic line 141 and are formed parallel to the third side 120*c* and the fourth side 120*d*, respectively, while being spaced apart from the third side 120*c* and the fourth side 120*d*, respectively. The end of the first sub-parasitic line 132 of the first parasitic line 130 is formed to be spaced apart from the end of the third sub-parasitic line 142 of the second parasitic line 140. Further, the end of the second sub-parasitic line 133 of the first parasitic line 130 is formed to be spaced apart from the end of the fourth sub-parasitic line 143 of the second parasitic line 140.

Circular polarization and the boresight gain may be controlled by symmetrically adjusting the lengths of the first sub-parasitic line 132 and the second sub-parasitic line 133 of the first parasitic line 130 and the third sub-parasitic line 142 and the fourth sub-parasitic line 143 of the second parasitic line 140.

In this way, the first parasitic line 130 and the second parasitic line 140, in which reverse current is induced, are disposed on the same layer as the square radiating patch 120 and parallel to the square radiating patch 120, thus enabling the direction of current induced in the antenna to be rotated depending on the phase. As a result, circular polarization may be implemented while the impedance matching characteristics and gain characteristics of the antenna are maintained.

The feeding via 150 is vertically formed through the substrate 110 and is used to electrically connect the ground plate (not shown), which will be described later, to the radiating patch 120.

The ground plate may be formed on the bottom of the substrate 110, and may be made of a metal material.

The current distribution of the circularly polarized GPS antenna 100 using parasitic lines according to the embodiment of the present invention is described below in light of the application of more specific design variables to the circularly polarized GPS antenna 100. First, the square radiating patch 120 is formed at the center of a CER10 substrate 110 (dielectric constant ($e_r$)=10, and tangent d (δ)=0.002), and the first parasitic line 130 and the second parasitic line 140 are formed to be spaced apart from the square radiating patch 120 and parallel thereto. The circularly polarized GPS antenna 100 is designed such that the length $w_1$ of one side of the square radiating patch 120 is 30 mm, the separation distance $w_2$ between the radiating patch 120 and the first and second parasitic lines 130 and 140 is 2 mm, the width $w_3$ of each of the first and second parasitic lines 130 and 140 is 2 mm, the interval $w_4$ between the first and second parasitic lines is 3 mm, and the distance $w_5$ from the second side 120*b* of the radiating patch 120 to the feeding via 150 is 9 mm. Here, the length 'p' of the first and second parasitic lines 130 and 140 may be symmetrically adjusted within the range from 0 mm to 31 mm.

Figure 2:
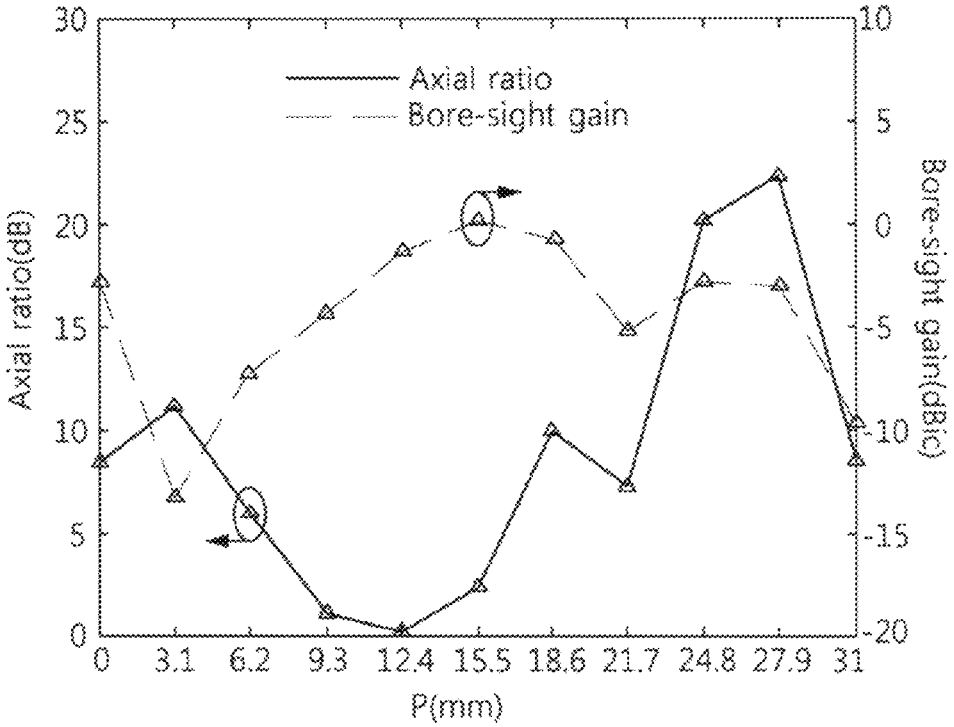
FIG. 2 is a graph showing variation in a boresight gain and an axial ratio depending on the value of a design variable 'p' in the circularly polarized GPS antenna using parasitic lines according to the embodiment of the present invention.
Figure 3:
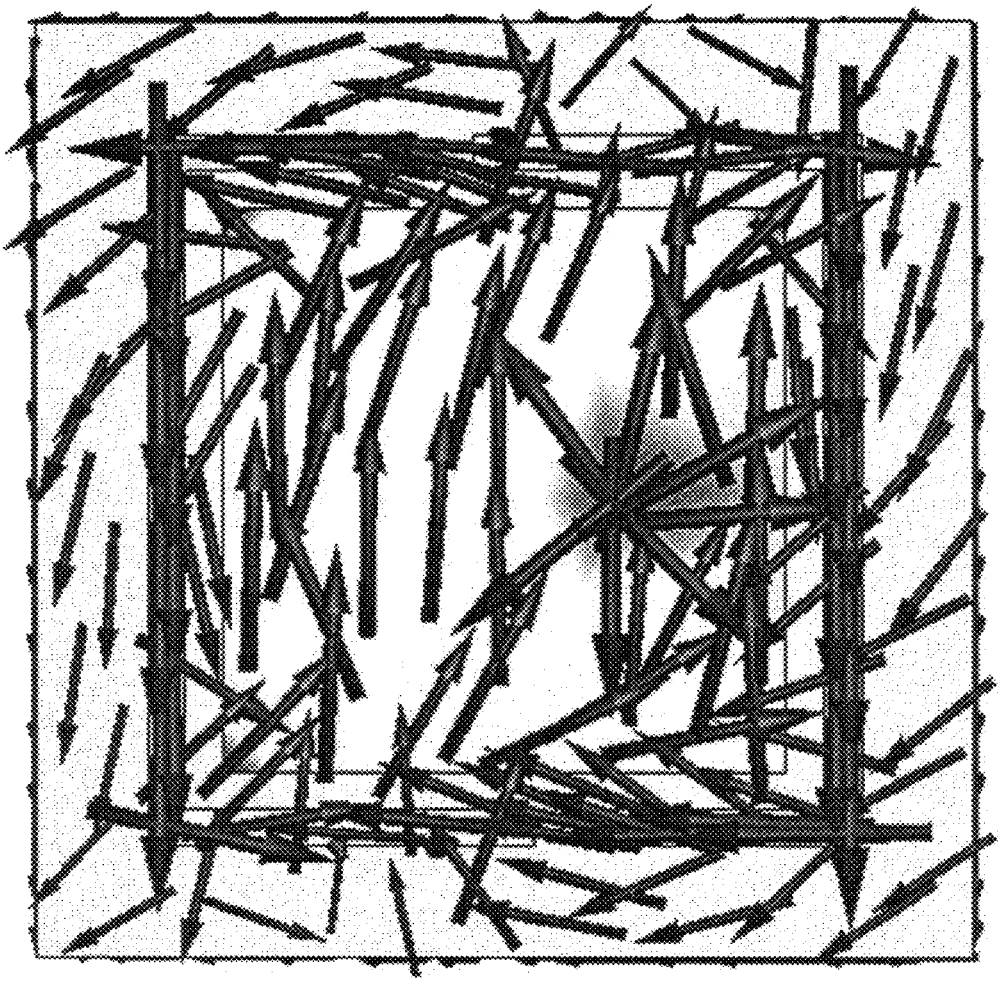
FIG. 3 is a distribution diagram for current induced in the circularly polarized GPS antenna using parasitic lines according to the embodiment of the present invention when the phase is 0°.
Figure 4:
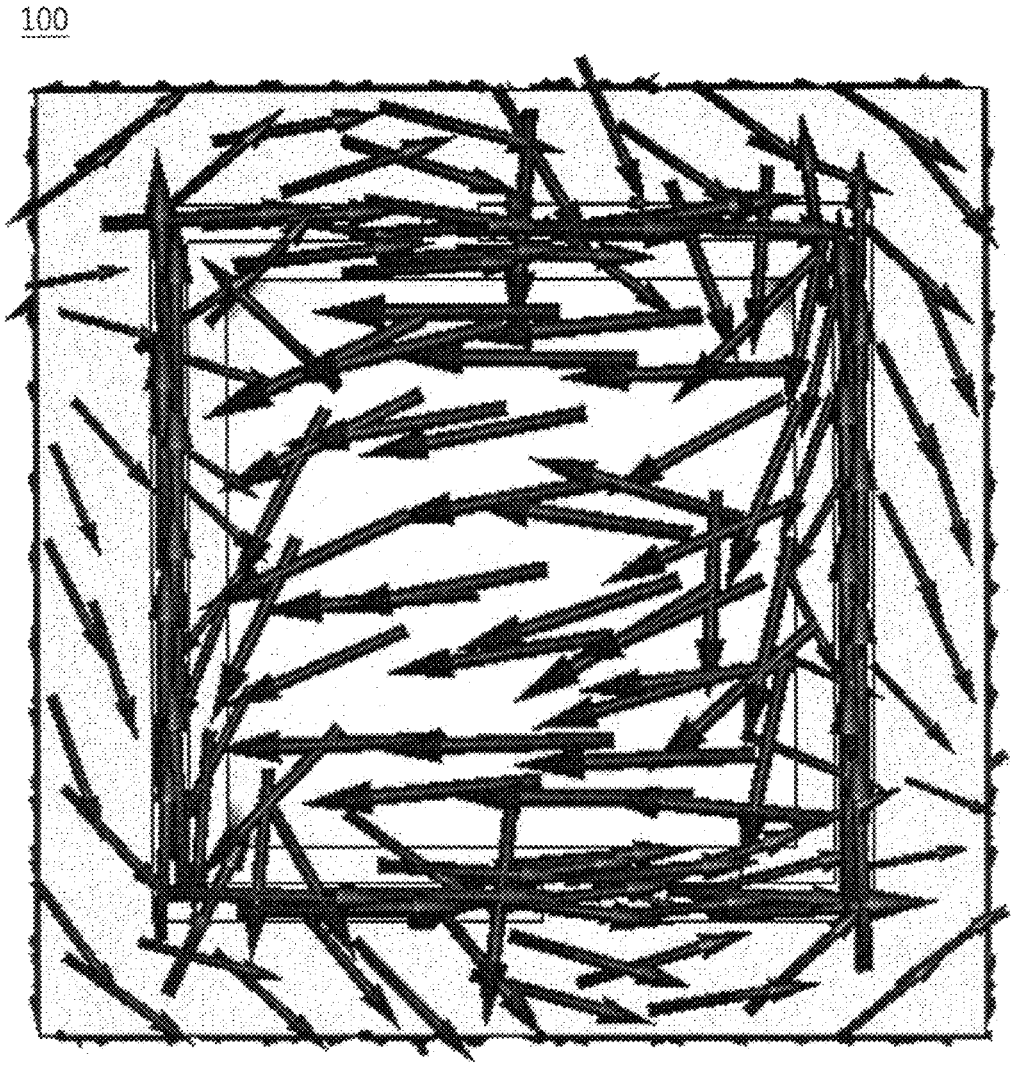
FIG. 4 is a distribution diagram for current induced in the circularly polarized GPS antenna using parasitic lines according to the embodiment of the present invention when the phase is 90°.
Figure 5:
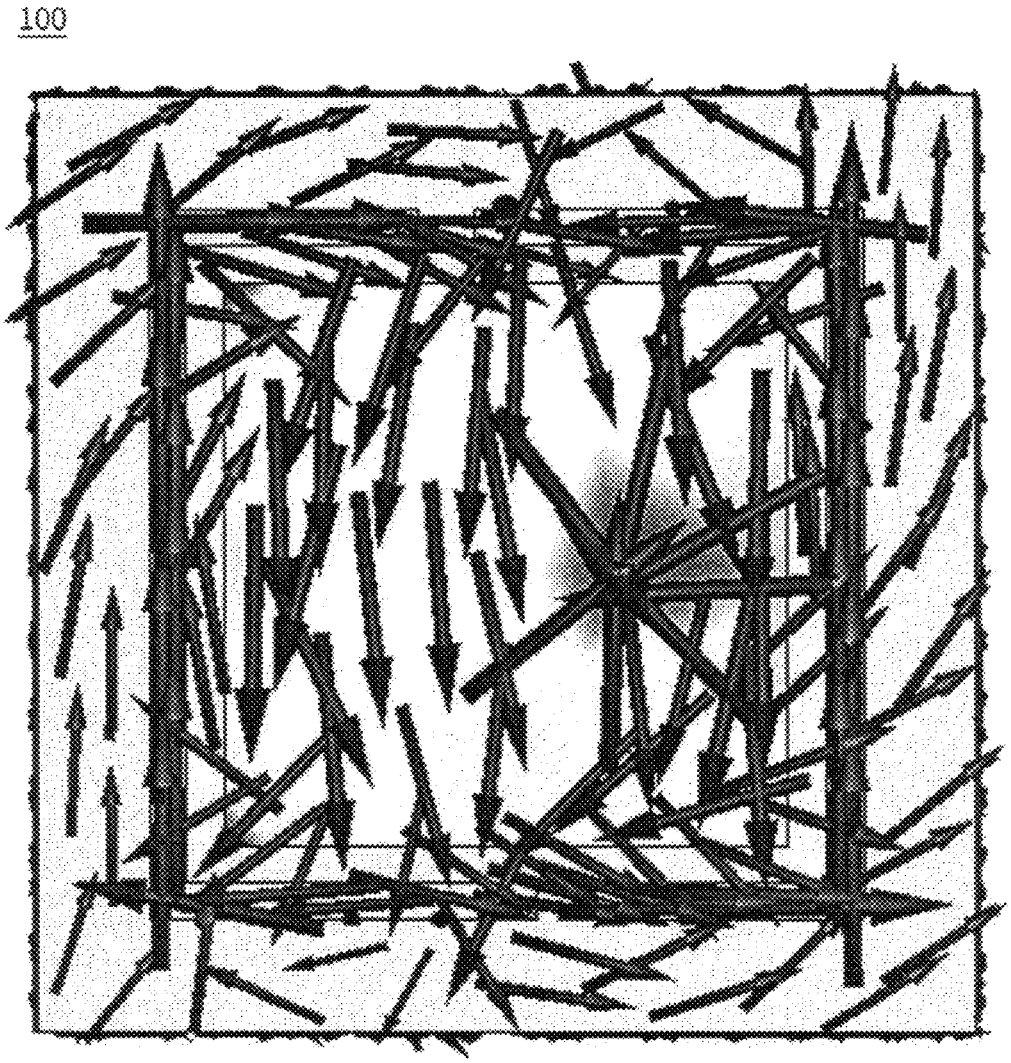
FIG. 5 is a distribution diagram for current induced in the circularly polarized GPS antenna using parasitic lines according to the embodiment of the present invention when the phase is 180°.
Figure 6:
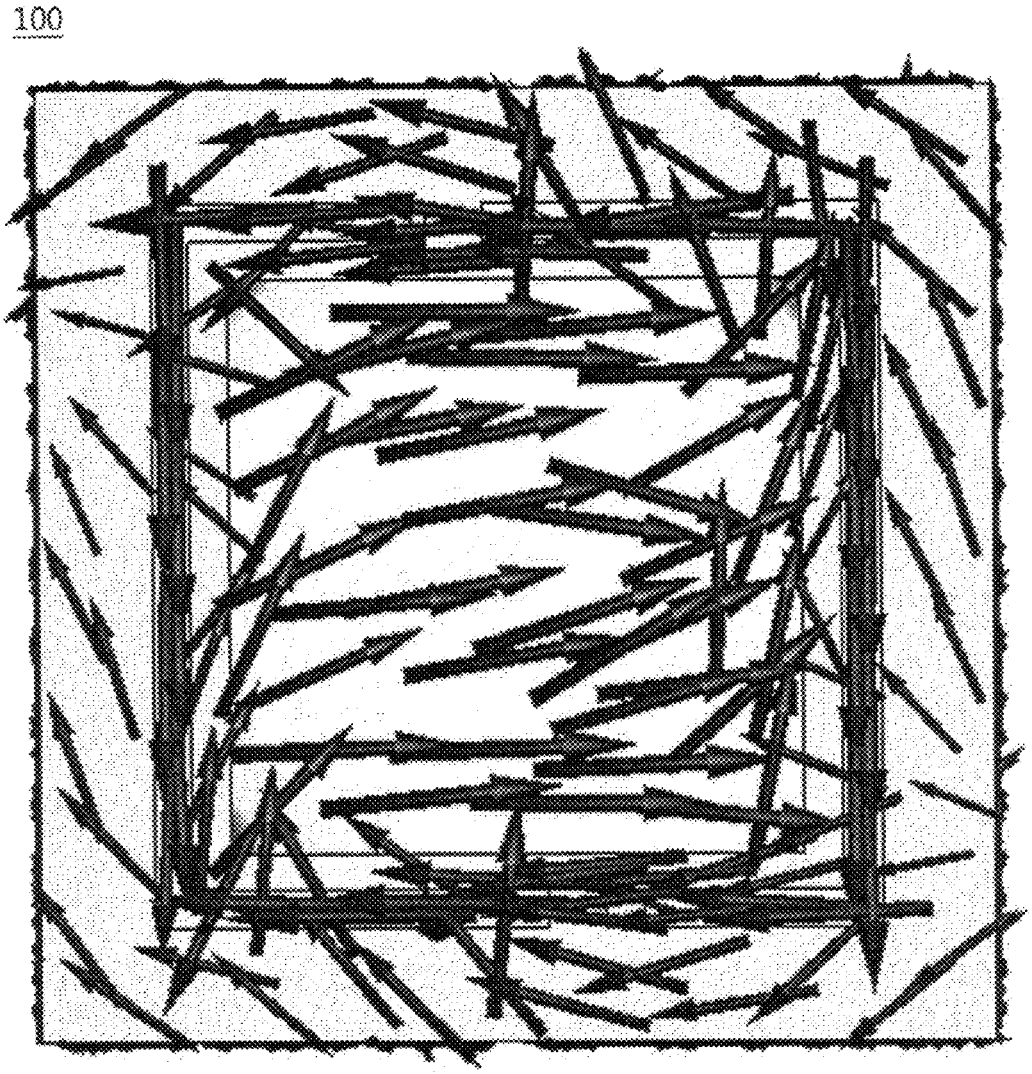
FIG. 6 is a distribution diagram for current induced in the circularly polarized GPS antenna using parasitic lines according to the embodiment of the present invention when the phase is 270°.

FIG. 2 illustrates variation in a boresight gain and an axial ratio depending on the value of the design variable 'p'. The boresight gain is maximized when the design variable 'p' is 15.5 mm, and exhibits a gain of −5 dBic or more in a wide range of the variable, from 9.3 mm to 21.7 mm. Since the axial ratio, which is an index for evaluating circular polarization, has a value of 3 dB or less in a wide range of 'p' from 9.3 mm to 15.5 mm, performance sensitivity to antenna design variables may be maintained low when the parasitic lines presented in the present invention are used.

FIGS. 3 to 6 are diagrams showing the current distribution of the presented antenna when 'p' is 12.4 mm, and respectively illustrate the distributions of currents induced in the antenna when the phase (wt) is 0°, 90°, 180°, and 270°, respectively. Current is induced in a parasitic line in the direction opposite to the direction in which current is induced in the radiating patch. The current of the radiating patch is rotated due to this reverse current, thus enabling circular polarization to be derived.

Below, the structure and operation of a circularly polarized GPS antenna using parasitic lines according to another embodiment of the present invention are described.

Figure 7:
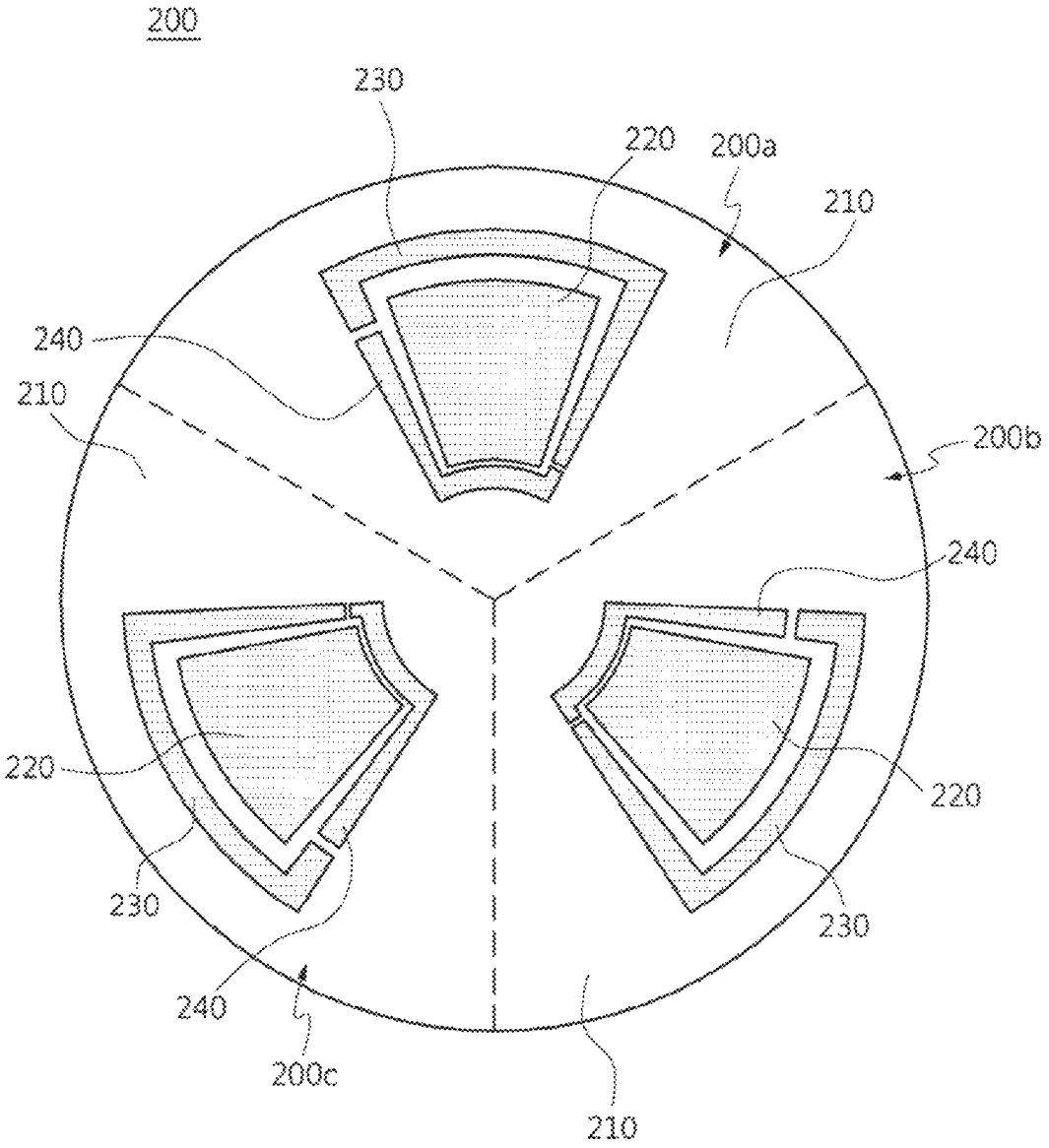
FIG. 7 is a plan view showing the structure of a circularly polarized GPS antenna using parasitic lines, which adopts a 3-element array antenna structure, according to another embodiment of the present invention.
Figure 8:
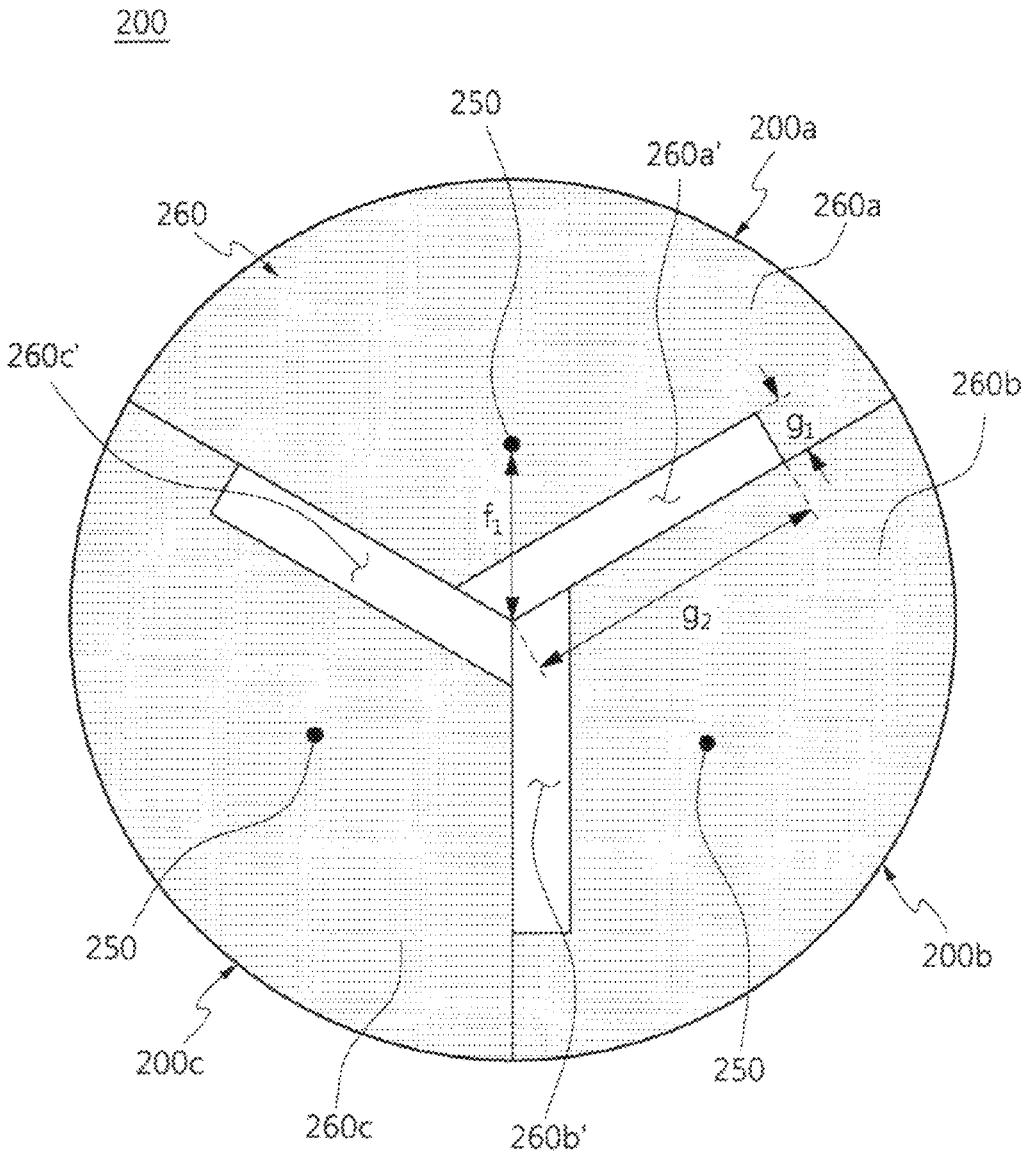
FIG. 8 is a bottom view showing the structure of the circularly polarized GPS antenna using parasitic lines, which adopts a 3-element array antenna structure, according to the other embodiment of the present invention.

FIG. 7 is a plan view showing the structure of a circularly polarized GPS antenna using parasitic lines, which adopts a 3-element array antenna structure, according to another embodiment of the present invention. FIG. 8 is a bottom view showing the structure of the circularly polarized GPS antenna using parasitic lines, which adopts a 3-element array antenna structure, according to the other embodiment of the present invention.

Referring to FIGS. 7 and 8 together, a circularly polarized GPS antenna 200 using parasitic lines according to the other embodiment of the present invention includes a first radiating part 200*a*, a second radiating part 200*b*, and a third radiating part 200*c*. Here, each of the first to third radiating parts 200*a* to 200*c* may be formed in a radial fan shape. When each of the first to third radiating parts 200*a* to 200*c* has a radial fan-shape, there are advantages in that the mounting space may be efficiently utilized in a circular array structure, and in that, even after scaling, circular polarization characteristics are maintained. Further, the first radiating part 200*a*, the second radiating part 200*b*, and the third radiating part 200*c* may constitute a Controlled Reception Pattern Antenna (CRPA).

The first to third radiating parts 200*a* to 200*c* may be configured using the same structure, but are formed at different locations. Below, a description will be made on the basis of the configuration of the first radiating part 200*a*, and the description of the first radiating part 200*a* substitutes for the description of the second radiating part 200*b* and the third radiating part 200*c*.

The first radiating part 200*a* is configured to include a substrate 210, a radiating patch 220, a first parasitic line 230, a second parasitic line 240, a feeding via 250, and a ground plate 260.

The radiating patch 220 is formed on the top of the substrate 210. This radiating patch 220 may be formed in a truncated fan shape so that the shape thereof corresponds to the shape of the radiating part 200*a*.

A parasitic line part including the first parasitic line 230 and the second parasitic line 240 is formed on the top of the substrate 210 and is disposed to be spaced apart from the radiating patch 220, thus inducing reverse current, with the result that circular polarization characteristics are implemented.

More specifically, the first parasitic line 230 is formed on the top of the substrate 210, and is disposed on one side of the radiating patch 220 while being spaced apart from the radiating patch 220.

Further, the second parasitic line 240 is formed on the top of the substrate 210, and is disposed on the other side of the radiating patch 220 while being spaced apart from the radiating patch 220. The second parasitic line 240 may be formed to be symmetrical with the first parasitic line 230 around the radiating patch 220.

The feeding via 250 is formed through the substrate 210 and is formed to connect the ground plate 260, which will be described later, and the radiating patch 220 to each other.

The ground plate 260 may be formed on the bottom of the substrate 210, and may be made of a metal material. More specifically, the ground plate 260 may be configured to include a first ground plate 260*a* formed on the bottom of the substrate 210 to correspond to the shape of the first radiating part 200*a*, a second ground plate 260*b* formed on the bottom of the substrate 210 to correspond to the shape of the second radiating part 200*b*, and a third plate 260*c* formed on the bottom of the substrate 210 to correspond to the shape of the third radiating part 200*c*. Slots 260*a*', 260*b*', and 260*c*' may be formed in respective portions of the first ground plate 260*a*, the second ground plate 260*b*, and the third ground plate 260*c*, which correspond to connecting portions between the multiple radiating parts 200*a*, 200*b*, and 200*c*. The slots 260*a*', 260*b*', and 260*c*' are formed to minimize coupling between the multiple radiating parts 200*a*, 200*b*, and 200*c* and maximize the performance of the CRPA. The width $g_1$ of the slots may be 9.5 mm, and the length $g_2$ of the slots may be 45.7 mm.

Below, the reflection coefficient performance, boresight gain, and axial ratio characteristics of the circularly polarized GPS antenna 200 using parasitic lines according to the other embodiment of the present invention, shown in FIGS. 7 and 8, will be described.

Figure 9:
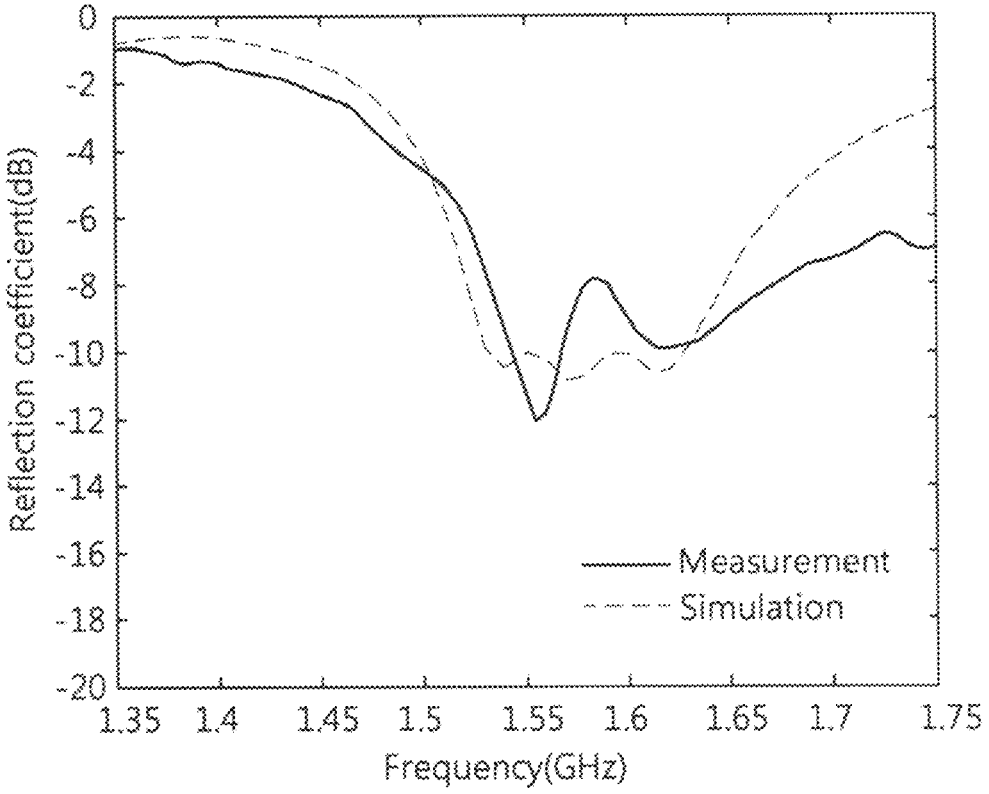
FIG. 9 is a graph showing the reflection coefficient performance of the circularly polarized GPS antenna using parasitic lines according to the other embodiment of the present invention.

FIG. 9 is a graph showing the reflection coefficient performance of the circularly polarized GPS antenna using parasitic lines according to the other embodiment of the present invention. It can be seen that a matching performance of −7.7 dB is exhibited at a frequency of 1.57542 GHz, which fails in the GPS L1 band.

Figure 10:
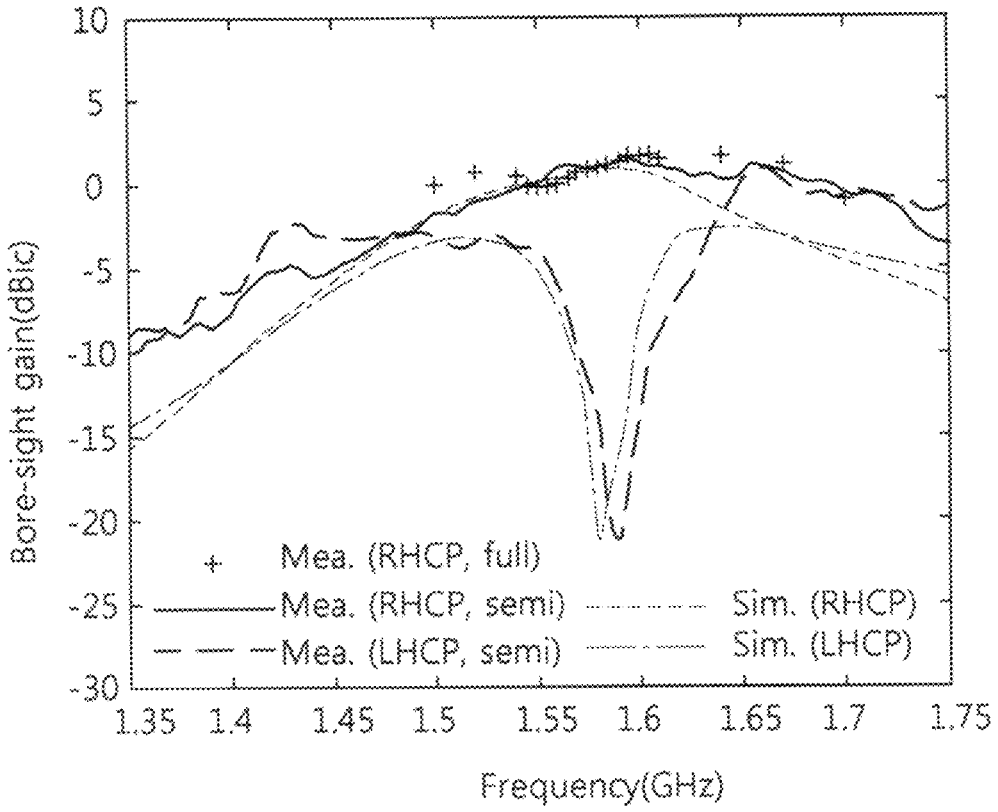
FIG. 10 is a graph showing the boresight gain performance of the circularly polarized GPS antenna using parasitic lines according to the other embodiment of the present invention.

FIG. 10 is a graph showing the boresight gain performance of the circularly polarized GPS antenna using parasitic lines according to the other embodiment of the present invention, wherein simulation results at 0.8 dBic and measurement results at 0.9 dBic are indicated.

Figure 11:
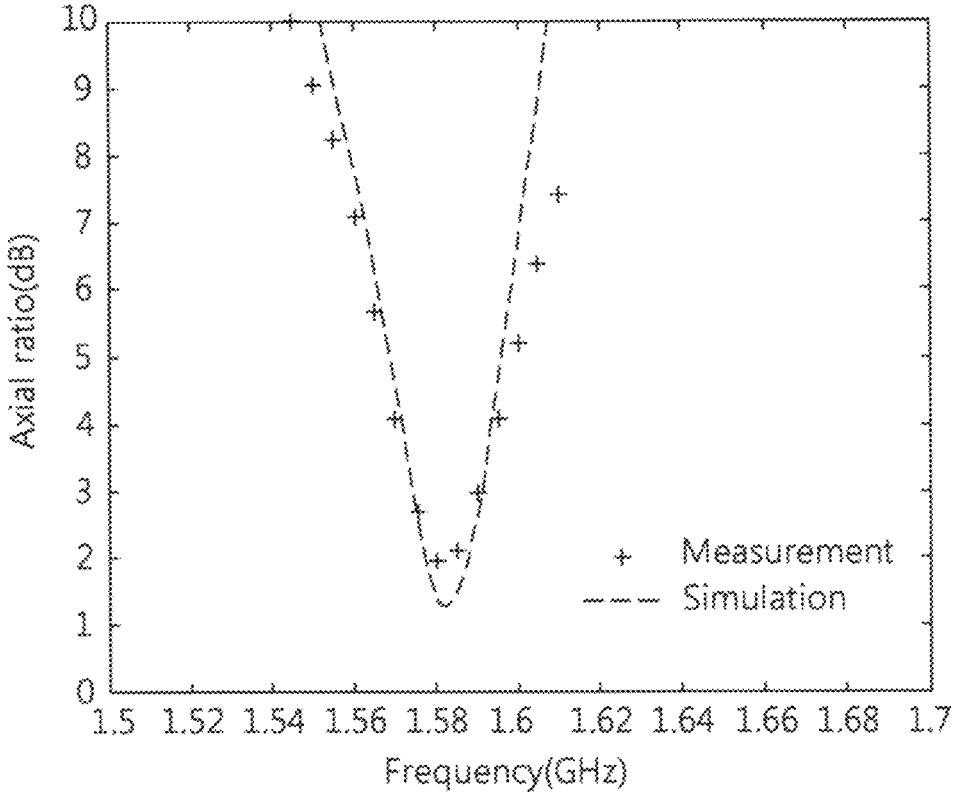
FIG. 11 is a graph showing the axial ratio characteristics of the circularly polarized GPS antenna using parasitic lines according to the other embodiment of the present invention.

FIG. 11 is a graph showing the axial ratio characteristics of the circularly polarized UPS antenna using parasitic lines according to the other embodiment of the present invention. It can be seen that an axial ratio of 3 dB or less is exhibited in a band of 30 MHz or more around the resonant frequency. In this way, the circularly polarized GPS antenna using parasitic lines, which is presented in the present invention, may also be applied to the structure of a small-sized array antenna. Further, when the GPS antenna is scaled in a radial fan shape, the efficiency of utilization of mounting space may be maximized while high-impedance matching, gain, and circular polarization characteristics may be maintained.

In accordance with the present invention, circular polarization is implemented, so that the efficiency of reception of satellite signals by a GPS antenna may be improved. More specifically, in the present invention, parasitic lines are arranged parallel to each other on a radiating patch, thus enabling circular polarization to be implemented while maintaining the impedance matching characteristics and gain characteristics of an antenna.

Further, the present invention is configured such that a radiating patch and parasitic lines are printed on a single layer, and thus mass production and cost reduction of antennas are facilitated while design complexity is minimized.

Furthermore, the present invention may be applied as a radial shape, so that the efficiency of utilization of mounting space in a circular array structure may be maximized, and thus the shape of the antenna according to the present invention is also suitable for the form of an individual element of a small-sized array antenna.

As described above, in the circularly polarized GPS antenna using parasitic lines according to the present invention, the configurations and schemes in the above-described embodiments are not limitedly applied, and some or all of the above embodiments can be selectively combined and configured so that various modifications are possible.

What is claimed is:

1. A circularly polarized Global Positioning System (GPS) antenna using parasitic lines, comprising:

a substrate;

a radiating patch formed on atop of the substrate;

a parasitic line part comprising a first parasitic line which has a first sub-parasitic line and a second sub-parasitic line and a second parasitic line which has a third sub-parasitic line and a fourth sub-parasitic line, each of which is formed on the top of the substrate and disposed spaced apart from the radiating patch, the parasitic line part being configured to controllably gain circular polarization characteristics by inducing reverse current and by symmetrically adjusting respective one of the lengths of the first sub-parasitic line and the second sub-parasitic line of the first parasitic line and the third sub-parasitic line and the fourth sub-parasitic line of the second parasitic line, the first parasitic line being symmetrically formed with the second parasitic line having a predetermined width;

a ground plate formed on a bottom of the substrate; and a feeding via formed through the substrate aid configured to electrically connect the ground plate to the radiating patch.

2. The circularly polarized GPS antenna of claim 1, wherein:

the first parasitic line is formed on the top of the substrate and disposed on one side of the radiating patch while being spaced apart from the radiating patch; and the second parasitic line is formed on the top of the substrate and disposed on a remaining side of the radiating patch while being spaced apart from the radiating patch.

3. The circularly polarized GPS antenna of claim 2, wherein the first parasitic line and the second parasitic line are symmetrically formed around the radiating patch.

4. The circularly polarized GPS antenna of claim 2, wherein the radiating patch is formed in a shape of a rectangle including a first side and a second side that are opposite each other, a third side configured to connect a first end of the first side to a first end of the second side, and a fourth side configured to connect a second end of the first side to a second end of the second side, and wherein the first, second, third and fourth sides have an identical length to enable the radiating patch to be formed in a shape of a square.

5. The circularly polarized GPS antenna of claim 4, wherein:

the first parasitic line comprises:

a first main parasitic line formed parallel to the first side while being spaced apart from the first side; and first and second sub-parasitic lines formed by extending and bending from the first main parasitic line and formed parallel to the third and fourth sides, respectively, the first and second sub-parasitic lines being spaced apart from the third and fourth sides, respectively, and the second parasitic line comprises:

a second main parasitic line formed parallel to the second side and spaced apart from the second side; and third and fourth sub-parasitic lines formed by extending and bending from the second main parasitic line and formed parallel to the third and fourth sides, respectively, the third and fourth sub-parasitic lines being spaced apart from the third and fourth sides, respectively.

6. The circularly polarized GPS antenna of claim 4, wherein an end of the first sub-parasitic line and an end of the third sub-parasitic line are formed spaced apart from each other, and an end of the second sub-parasitic line and an end of the fourth sub-parasitic line are formed spaced apart from each other.

7. The circularly polarized GPS antenna of claim 6, wherein lengths of the first sub-parasitic line, the second sub-parasitic line, the third sub-parasitic line, and the fourth sub-parasitic line are symmetrically adjusted, thereby controlling circular polarization and a boresight gain.

8. A circularly polarized Global Positioning System (GPS) antenna using parasitic lines, comprising:

a plurality of radiating parts, each comprising:

a substrate;

a radiating patch formed on a top of the substrate;

a parasitic line part comprising a first parasitic line which has a first sub-parasitic line and a second sub-parasitic line and a second parasitic line which has a third sub-parasitic line and a fourth sub-parasitic line, each of which is formed on the top of the substrate and disposed to be spaced apart from the radiating patch, the parasitic line part being configured to controllably gain circular polarization characteristics by inducing reverse current and by symmetrically adjusting the lengths of the first sub-parasitic line and the second sub-parasitic line of the first parasitic line and the third sub-parasitic line and the fourth sub-parasitic line of the second parasitic line, the first parasitic line being symmetrically formed with the second parasitic line having a predetermined width;

a ground plate formed on a bottom of the substrate; and a feeding via formed through the substrate and configured to electrically connect the ground plate to the radiating patch.

9. The circularly polarized GPS antenna of claim 8, wherein:

the first parasitic line is formed on the top of the substrate and disposed on one side of the radiating patch while being spaced apart from the radiating patch; and the second parasitic line is formed on the top of the substrate and disposed on a remaining side of the radiating patch while being spaced apart from the radiating patch.

10. The circularly polarized GPS antenna of claim 9, wherein each of the plurality of radiating parts is formed in a radial fan shape, and the radiating patch is formed in a truncated fan shape corresponding to the shape of the corresponding radiating part.

11. The circularly polarized GPS antenna of claim 10, wherein the plurality of radiating parts comprise a Controlled Reception Pattern Antenna (CRPA).

12. The circularly polarized GPS antenna of claim 11, wherein the ground plate is configured such that slots are formed in portions of the ground plate, corresponding to connecting portions between the radiating parts.

* * * * *